United States Patent [19]

Wilkins

[11] Patent Number: 4,819,296

[45] Date of Patent: Apr. 11, 1989

[54] DOOR SAFETY BRACE HAVING A HINGE WITH ANGLED END FACES

[75] Inventor: Donald J. Wilkins, Gooding, Id.

[73] Assignee: Wilco Enterprises, Gooding, Id.

[21] Appl. No.: 43,605

[22] Filed: Mar. 24, 1987

[51] Int. Cl.[4] ..... E05F 5/02

[52] U.S. Cl. ..... 16/82; 16/293; 292/339

[58] Field of Search ..... 16/82, 291, 293, 346; 292/338, 339, 259 R, 271; 254/39

[56] References Cited

U.S. PATENT DOCUMENTS

| | | | |
|---|---|---|---|
| 154,150 | 8/1874 | Parliman | 16/346 X |
| 790,653 | 5/1905 | Notthoff | 292/339 |
| 1,687,517 | 10/1928 | Sasgen | 292/338 |
| 4,036,518 | 7/1977 | Jost | 292/339 |
| 4,139,227 | 2/1979 | Spurr | 292/339 |
| 4,139,277 | 2/1979 | Berg . | |
| 4,157,128 | 6/1979 | Peters | 292/339 |
| 4,231,599 | 11/1980 | Gayman | 292/339 |
| 4,300,796 | 11/1981 | Lane | 292/339 |

*Primary Examiner*—Fred A. Silverberg

*Attorney, Agent, or Firm*—Berman, Aisenberg & Platt

[57] ABSTRACT

A door safety brace has an upper rod member and a lower rod member pivotally connected by an over-center self-locking hinge which holds the brace in a rigid, substantially rectilinear position when the over-center hinge is in locked position. The upper end of the brace has a curved yoke attached thereto for securing under the handle of a door to be braced and the lower end of the brace has a rubber cup for frictionally engaging the floor. The over-counter locking hinge is formed by fabricating end faces of each hinge member at an angle between ½° and 2½° from a perpendicular to the longitudinal axis of each rod member, thus providing an over-center locking hinge angled at a total angle of between 1° and 5° over-center when the brace is in locked position.

1 Claim, 1 Drawing Sheet

DOOR SAFETY BRACE HAVING A HINGE WITH ANGLED END FACES

FIELD OF THE INVENTION

The invention concerns a safety device for bracing a door.

BACKGROUND OF THE INVENTION

Hinged braces for placing against a door to prevent the door being opened are well known, but none of the known braces has a satisfactory self-locking hinge which secures the brace in position against the door.

The patent to Notthoff, U.S. Pat. No. 790,653, shows a device which engages under the handle of a closed door when the hinge is straightened, but the hinge is not self-locking. The door brace of Notthoff requires a removable hinge pin to release the hinge. The patent to Gayman, U.S. Pat. No. 4,231,599 shows a door brace having a complicated foot device and a chain device to secure the safety brace to the door. The door guard of Spurr, U.S. Pat. No. 4,139,227 has adjustable pivotable members which are overlapped, forming a weak point where the upper member engages against the lower member. Lane, U.S. Pat. No. 4,300,796, also shows an adjustable prop which has an inner member extending from within an outer member without provision of a hinge. The patent to Peters, U.S. Pat. No. 4,157,128, shows a ladder hinge which has a complex self-locking feature including a pair of circular plates rigidly fixed to opposite faces of one ladder member and rotatably connected to the other ladder member, the hinge being locked by means of a locking ring slidably engaged with the other member. The door brace of Jost, U.S. Pat. No. 4,036,518, also has one member extending from within the other member to the required length, without using a hinge.

SUMMARY OF THE INVENTION

A door safety brace of the invention includes an upper rod hinged to a lower rod for bracing against one side of a closed door, the rods being joined together by an over-center locking hinge which locks the hinged rods in a rigid, substantially rectilinear position. The over-center locking hinge includes angled means which engage against each other to provide the over-center locking feature. When the door safety brace is engaged against a door, yoke means attached to the upper end of the upper rod engage under the handle of the door to be braced in closed position, and a flexible cup, engaged over the lower end of the lower rod, frictionally engages the floor. The over-center locking hinge is formed by two hinge members pivotally connected to each other, each hinge member having an end angled from a perpendicular to the longitudinal axis of the rod to which the hinge member is connected. The two rods are pivotally connected at the hinge to form a rigid, substantially rectilinear brace, the angled ends of each rod engaging against each other is over-center relationship when the hinge is in locked position.

An object of the invention is to provide an improved door safety brace which withstands strong forces against the door.

A further object of the invention is to provide an over-center locking hinge connecting elongated members forming a door safety brace.

DETAILED DESCRIPTION OF THE INVENTION

The door safety brace of the invention is a folding brace which will fit into a regular suitcase when in folded position. It is thus easily transported on journeys, for use in a hotel room or other location where security against intruders is required. The device yoke is engaged under the door handle and the brace foot is placed on the floor. The mechanical advantage and self locking functions of the device are obtained by exerting a lateral lifting force to the hinge at which time the brace foot is moved toward the door about 1½ inches. A lateral downward force of about 10 pounds then applied to the hinge pushes the hinge over-center into a substantially rectilinear locked position resulting in a static linear force of about 200 pounds. The brace is unlocked by exerting a lifting lateral force to the hinge.

Figure 1:
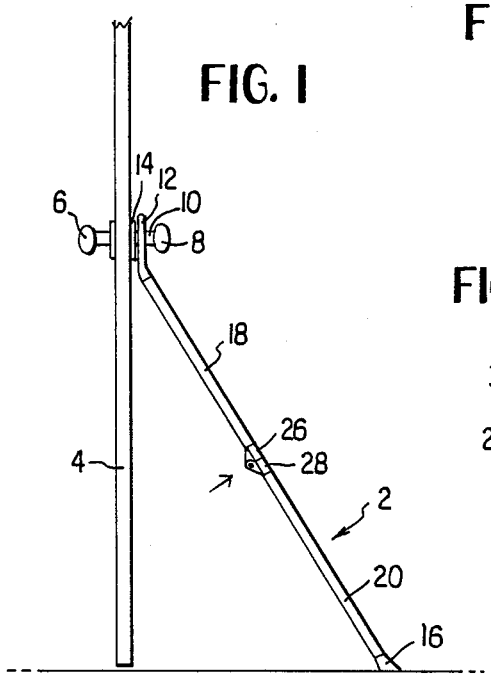
FIG. 1 is a side elevation view of a door safety brace in position bracing a door.

Referring to the Figures, in which like numerals represent like parts, FIG. 1 shows door brace 2 in locked position engaged against door 4 which has a handle with an exterior knob 6 and an interior knob 8. The door safety brace of the invention can be used against any door having a handle which is supported by a neck, such as neck 10, against which yoke 12 of brace 2 engages. In use, yoke 12 is engaged against neck 10, between a plate 14 usually associated with a door handle and knob 8, and foot piece 16 is placed on the floor in the approximate position necessary for bracing the door, with upper rod 18 and lower rod 20 being hinged together in angled, unlocked relationship to each other. The hinge is then locked into the position seen in FIG. 1, bracing the door against external force. When locked against a door, the door brace locks in positive over-center locking position under a compression load and cannot be dislodged from its braced position unless a lateral force is applied to unlock the hinge, the direction of the lateral force being shown by the arrow in FIG. 1.

Figure 2:
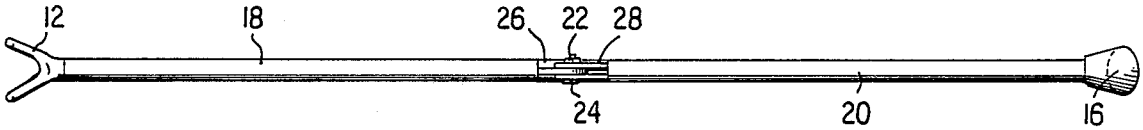
FIG. 2 is a bottom view of a door safety brace in extended position.
Figure 3:
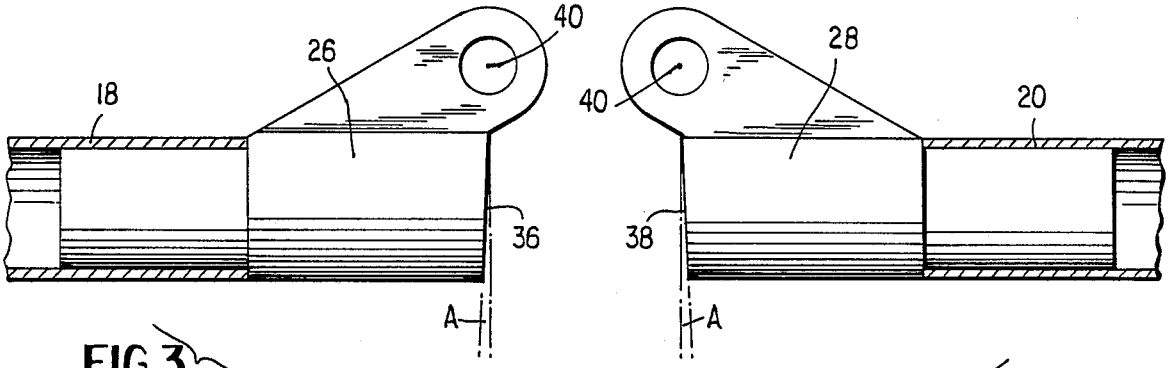
FIG. 3 is an exploded side elevation view of ends of the upper and lower rod members which are pivotally hinged together in use.
Figure 4:
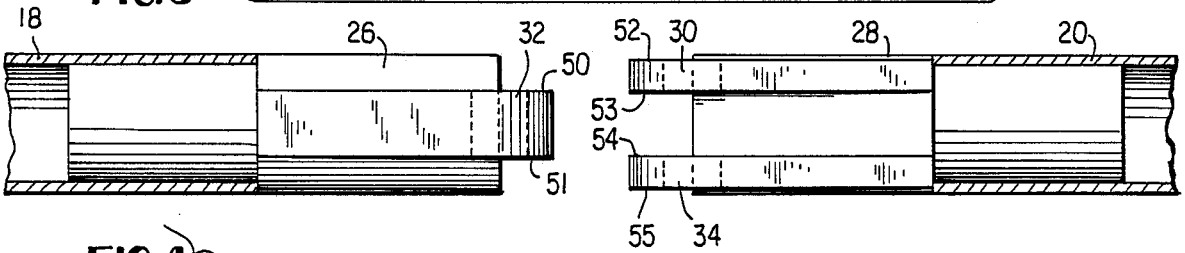
FIG. 4 is an exploded top view of the parts shown in FIG. 3.

FIG. 2 shows hinge members 26, 28 held by bolt 22 and secured by nut 24. The hinge, shown in detail in FIGS. 3 and 4, comprises hinge member 26 engaged with upper rod member 18 and hinge member 28 engaged with lower rod member 20. Hinge members 26 and 28 are pivotally connected by bolt 22 which passes through bolt holes 30, 32 and 34 successively, bolt 22 being secured by nut 24, as illustrated in FIG. 2. Upper rod 18 and lower rod 20 are thus pivotally hinged together. Other means of pivotal connection may be used. Positive self-locking functions of the over-center hinge are obtained by precision fabrication and do not depend on frictional characteristics of the hinge and/or bolt.

Figure 5:
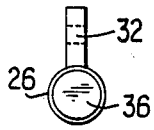
FIG. 5 is an end view of the lower end of the upper rod member showing the hinge.
Figure 6:
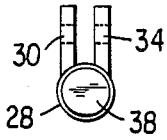
FIG. 6 is an end view of the upper end of the lower rod member showing the hinge.

FIGS. 5 and 6 show an end view of each part 26, 28 of the hinge. To provide the over-center self-locking hinge of the invention, faces 36, 38 of hinge members 26, 28, respectively, are precisely made so that when the hinge members are connected together and the hinge locked, an over-center positive locking hinge angled between 1° and 5° over-center is provided. Each face 36, 38 is fabricated, for example, at an angle A between about ½° and 2½° from a plane perpendicular to the longitudinal axis of each rod 18, 20, and the perpendicular plane is taken through the center 40 of each bolt hole 30, 32 and 34. When the hinge members 26, 28 are pivotally connected by bolt 22 and nut 24, faces 36, 38 are engaged against each other in an over-center relationship with respect to the longitudinal axes of the upper and lower rods.

An over-center locking hinge automatically locks when the brace is straightened into a substantially rectilinear position. A straight hinge does not provide a locking function and is immediately displaced by any linear force applied to the brace. Moreover, an over-center locking hinge provides substantially more resistance to force exerted against the opposite side of a door from the side braced than is provided by other types of hinge.

Figure 9:
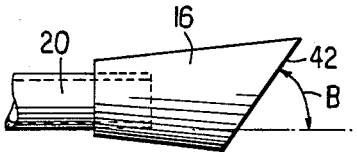
FIG. 9 is a side elevation view of the lower end of the lower rod member showing a rubber cup engaged on the lower end.
Figure 10:
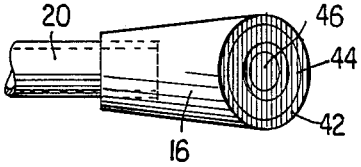
FIG. 10 is a bottom plan view of the lower end of the lower rod member showing the rubber cup engaged on the lower end.

Referring now to foot piece 16, FIGS. 9 and 10 show details thereof. The foot piece 16 is formed preferably as a medium soft rubber cup engaged on the lower end of the lower rod member. Cup 16 is angled so that base surface 42 of cup 16 extends at an angle B to the longitudinal axis of the lower rod. Angle B is generally between about 50° and 60°, and preferably about 55° to provide an increase in floor engagement area and thus an increase in slide resistance. Base surface 42 of cup 16, shown in FIG. 10, preferably has concave groove 44 cut into base surface 42 which forms a structure which functions as a suction cup, enhancing the frictional stability of the brace on the floor. Center portion 46 may also be hollowed out to provide a further suction cup effect. Cup 16 is made of resilient flexible material, such as rubber, flexible plastic, plastic coated metal or other suitable material. Rubber or flexible plastic are preferred. Cup 16, angled at 55°, as described, resists displacement when more than 600 lb. pressure is applied in the direction of the length of the rod members, when a suction cup structure is cut into floor-engaging base surface 42. Cup 16, having its floor-engaging base surface 42 cut at 55° to the longitudinal axis, has 400% greater floor contact area than a straight cut base on the lower rod member, thus greatly increasing slide resistance.

Figure 7:
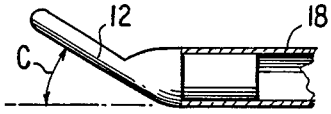
FIG. 7 is a side elevation view of the upper end of the upper rod member showing the yoke.
Figure 8:
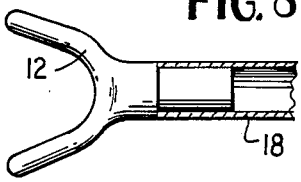
FIG. 8 is a top plan view of the upper end of the upper rod member showing the yoke.

Yoke 12 preferably has a curved U-shaped form as shown in FIGS. 7 and 8. The curved form may have a radius of about ⅝ in. Yoke 12, which is carried by the upper end of upper rod 18, may be covered with a plastic coating to prevent marring of the door or door handle. Yoke 12 is positioned with respect to the longitudinal axis of upper rod 18 at an angle C. Angle C is generally between 30° and 40° to the longitudinal axis of the upper rod member, preferably about 35° to the rod axis.

The angle of the yoke and the angle at the base of the foot piece are chosen to provide the greatest resistance against force applied against the opposite side of the door to the door brace. A door handle is generally between 34 in. and 39 in. above the floor, and when the brace is engaged under the neck of the door handle, maximum force is required to break the brace when the angle of the yoke is approximately 35° to the longitudinal axis of the upper rod member, and the angle of the foot piece is approximately 55° to the longitudinal axis of the lower rod member. The over-center positive self-locking hinge needs little pressure to lock the brace but affords excellent mechanical advantage by providing more resistance to forced entry than the door structure itself, in most instances.

In a non-limiting example, the upper and lower rod members 18, 20 are preferably made from aluminum tubing, suitably of 0.62 in. internal diameter and 0.75 in. external diameter. The hinge pieces 26, 28, which fit into ends of rod members 18, 20, are suitably made of cast aluminum secured together by a 3/16 in. grade 8 bolt 22 which is inserted through bolt holes 30, 32 and 34, which may each be ¼ in. in diameter, and secured with an appropriately sized nut. End faces 36, 38 of hinge pieces 26, 28 are precisely machined at the required angle for the over-center locking hinge. The overall length of a door safety brace 2 of the invention, in locked position, is generally between about 40 in. and 48 in., preferably about 44 in., the brace folding into two sections each about 22 in. in length. Other sizes may be used as required, and other materials may be equally applicable.

Positive lock function of the pivoted hinge members requires a minimum of about 1° over-center locking and a maximum of about 5° over-center locking. Design in excess of 5° is unnecessary to the positive lock function of the hinge and can result of loss of device integrity when excessive hinge angle is utilized. In a preferred example, surfaces 50, 51, 52, 53, 54, 55 of hinge members 26, 28 are precision machined parallel to each other, with about 0.0015 in. clearance between the surfaces allowing ease of hinge movement while retaining alignment and stability. The hinge bolt holes are precision drilled to about 0.0015 in. bolt clearance. Positive locking function of the over-center hinge structure is obtained by precision machining and does not depend on a frictional fit of the hinge. The positive locking function of the hinge increases in proportion to the increase in linear compression force applied to the brace. Properly installed, a brace of the invention may be under a static compression load of 150 to 200 lb. The greater the force applied to the opposite side of the door handle to the brace, the greater the force necessary to unlock the over-center hinge. For example, a 250 lb. force outside the door requires about an 18 lb. lateral force to unlock the hinge, and a 500 lb. force outside the door requires about a 24 lb. lateral force for unlocking.

The door safety brace 2 of the invention provides a secure engagement of the door lock assembly, and yoke 12 prevents rotation of the brace, thus avoiding inadvertent displacement of the device. The angle of the yoke in relation to the brace maintains maximum surface contact with the door plate and provides adequate clearance between the door knob and the brace to allow ease of installation and ease of removal of the brace of the invention.

While the invention has been described above with respect to certain embodiments thereof, it will be appreciated that variations and modifications may be made without departing from the spirit and scope of the invention.

What is claimed is:

1. A removable door safety brace for securing between a handle of a closed hinged door and a floor comprising:

hinged rod means comprising hollow tubular upper rod means having yoke means inserted into said rod means at its upper end for engaging the handle of the closed door and hollow tubular lower rod means having foot means comprising resilient cup means at its lower end for frictionally engaging the brace against the floor, and over-center locking hinge means pivotally connecting together said upper rod means at its lower end and said lower rod means at its upper end for locking said hinged rod means in a rigid, substantially rectilinear position, wherein a downward force exerted on the over-center locking hinge means in a direction toward the closed door locks the hinge, an upward force exerted on the over-center locking hinge means in a direction away from the closed door opens the hinge, and a force on the opposite side of the closed door acts on the locked over-center hinge to further brace the door against opening, said over-center locking hinge means further comprising:

hinge means of said upper rod means having means for inserting into a hollow lower end of said upper rod means, and end face means for forming an over-center hinge angled at between $\frac{1}{2}°$ and $2\frac{1}{2}°$ from a plane perpendicular to the longitudinal axis of said upper rod means, and hinge means of said lower rod means pivotally connected to said hinge means of said upper rod means, said hinge means of said lower rod means having means for inserting into a hollow upper end of said lower rod means, and end face means for forming an over-center hinge angled at between $\frac{1}{2}°$ and $2\frac{1}{2}°$ from a plane perpendicular to the longitudinal axis of the lower rod means, wherein said end face means of said upper rod means engages against said end face means of said lower rod means forming a rigid, substantially rectilinear brace when said hinge is in over-center locked position secured between said handle of the closed door and the floor, and said pivotal connection of the hinge means is substantially perpendicular to the pivot axis of the door hinges.

* * * * *